US005095855A

United States Patent [19]

Fukuda et al.

[11] Patent Number: 5,095,855

[45] Date of Patent: Mar. 17, 1992

[54] COOLING DEVICE FOR AN INTERNAL-COMBUSTION ENGINE

[75] Inventors: Sunao Fukuda, Handa; Kazuhiko Asano, Nagoya; Akihito Tanaka, Toyohashi; Sumio Susa, Anjo, all of Japan

[73] Assignee: Nippondenso Co., Ltd., Kariya, Japan

[21] Appl. No.: 635,957

[22] Filed: Dec. 28, 1990

[30] Foreign Application Priority Data

Dec. 28, 1989 [JP] Japan ..... 1-343568
Aug. 27, 1990 [JP] Japan ..... 2-226079

[51] Int. Cl.[5] ..... F01P 5/10
[52] U.S. Cl. ..... 123/41.44; 123/41.1
[58] Field of Search ..... 123/41.1, 41.44, 41.47, 123/198 L

[56] References Cited

U.S. PATENT DOCUMENTS 4,759,316 7/1988 Itakura ..... 123/41.1

FOREIGN PATENT DOCUMENTS 60-41516 3/1985 Japan .
60-49219 4/1985 Japan .
60-55723 4/1985 Japan .
63-190520 12/1988 Japan .

*Primary Examiner*—Noah P. Kamen
*Attorney, Agent, or Firm*—Cushman, Darby & Cushman

[57] ABSTRACT

A cooling device for an internal combustion engine has an additonal water pump and a bypass conduit which bypasses the additional water pump. When the amount of heat radiation of the radiator is insufficient, the additional water pump is driven by an electric motor. When the additional water pump is not necessary, the bypass conduit is opened, so that the cooling fluid bypasses the additional pump.

8 Claims, 11 Drawing Sheets

COOLING DEVICE FOR AN INTERNAL-COMBUSTION ENGINE

FIELD OF THE INVENTION

The present invention relates to a cooling device for an internal combustion engine, for instance, of an automobile.

BACKGROUND OF THE INVENTION

FIG. 9 shows a conventional cooling device wherein an engine 301 and a radiator 302 are connected to each other by conduits 304 through which a cooling fluid for cooling the engine 301 is circulated by a water pump 303. A bypass conduit 305 is connected to the conduits 304 at both an inlet portion and an outlet portion of the radiator 302. When the temperature of cooling fluid flowing out of the radiator 302 is above a predetermined value, the cooling fluid flows through bypass conduit 305 to bypass the radiator 302. When the temperature of the cooling fluid is below the predetermined value, a thermostat valve 306 closes the bypass conduit 305 so that the cooling fluid flows into the radiator 302 to be cooled. A heater core 308 is provided in the conduit 304. In order to cool the engine 301 efficiently, it is required that the cooling efficiency of the cooling device be controlled according to the condition of the engine 301, which varies frequently. The water pump 303 is driven by the engine 301 and the discharge capacity of water pump 303 is determined so as to prevent cavitation of the cooling fluid in the water pump 303 and to circulate plenty of cooling fluid even under extreme conditions, for instance, where the automobile climbs a slope at low speed.

Recently, engines have become more powerful and transmit more heat to the cooling fluid. Therefore, the radiator and a cooling fan are required to be large enough to radiate the heat efficiently. However, the engine compartment has become increasingly smaller, making if harder to use large radiators and cooling fans. One idea to radiate the heat more efficiently is to make the discharge capacity of the water pump larger. However, the increment of the discharge capacity of the water pump causes cavitation when the water pump rotates at high speed, and a loss of power due to the water pump when cooling requirements are lower. Therefore, increasing the discharge capacity of the water pump is not practical and it is hard to increase the flow rate of circulating cooling fluid under a condition of low rotation and high load of the engine.

Japanese unexamined utility model (Kokai) 63-190520 shows a cooling device which has an additional water pump 320 beside the main water pump 303 as shown in FIG. 10. Since the main water pump 303 is driven by the engine 301, the discharge volume of the main water pump 303 varies frequently according to the revolutions per minute (r.p.m.) of the engine. The shortage of cooling fluid or the surplus of cooling fluid arises under certain conditions of the main water pump 303 and the additional water pump 320. Sufficient cooling fluid is not supplied according to the engine rotation and load by merely providing the additional water pump 320.

FIG. 3 shows the relation between the r.p.m. of the water pump and the discharge volume (flow rate) thereof. The flow rate of the main water pump increases in proportion to the r.p.m. as shown by line A in FIG. 3. When the r.p.m. is low, which means that the automobile is climbing a slope at low speed or the engine 301 is idling, the flow shortage of the cooling fluid becomes apparent. The total flow of the main water pump 303 and the additional water pump 320 is represented by broken line C, which shows that the flow is not increased tremendously. The reason why the sufficient increment of flow is not achieved is that the cooling fluid discharged from the additional water pump 320 recirculates into the inlet of the additional water pump 320 through the bypass conduit 330. Such a short-circuit of the cooling fluid can be prevented by providing a one way valve 331 in the bypass conduit 330.

Since the one way valve 331 has a flowing resistance, the amount of cooling fluid flowing in the bypass conduit 330 and the additional water pump 320 is determined, based on the flowing resistance of the way valve 331 and the additional water pump 320. In other words, even if the engine 301 rotates at high speed and the pumping operation of the additional water pump 320 is not necessary, a certain amount of the cooling fluid flows into the additional water pump 320 according to the resistance of the one way valve 331. The resistance of the one way valve 331 also restricts the flow of the cooling fluid discharged from the main water pump 303. The resistance of the one way valve 331 is not variable according to the heat load of the engine 301.

As described above, the conventional cooling device does not operate well according to the frequently varying condition of the engine.

SUMMARY OF THE INVENTION

An object of the present invention is to maintain a sufficient flow of cooling fluid when high cooling capacity is necessary, so that the cooling efficiency of the engine is improved.

To achieve the object described above, the present invention has a first circulating means for circulating the cooling fluid and a second circulating means which is connected to the first circulating means in series and which circulates the cooling fluid independently from the first circulating means when the temperature of the cooling fluid is above a certain value. A second bypass conduit bypassing the second circulating means is provided and a valve means is provided in the second bypass conduit. The valve means closes the second bypass conduit unless the flow rate of cooling fluid circulated by the first and the second circulating means is above a predetermined value.

The first circulating means circulates the cooling fluid with a driving force supplied by the engine. When the temperature of the cooling fluid rises above the predetermined value, the second circulating means starts to operate and the flow rate of circulating cooling fluid is increased.

When the total amount of the cooling fluid circulated by both circulating means rises above the predetermined amount, the valve means opens the second bypass conduit so that some of the circulating cooling fluid bypasses the second circulating means and flows into the second bypass conduit.

PREFERRED EMBODIMENT

Figure 1:
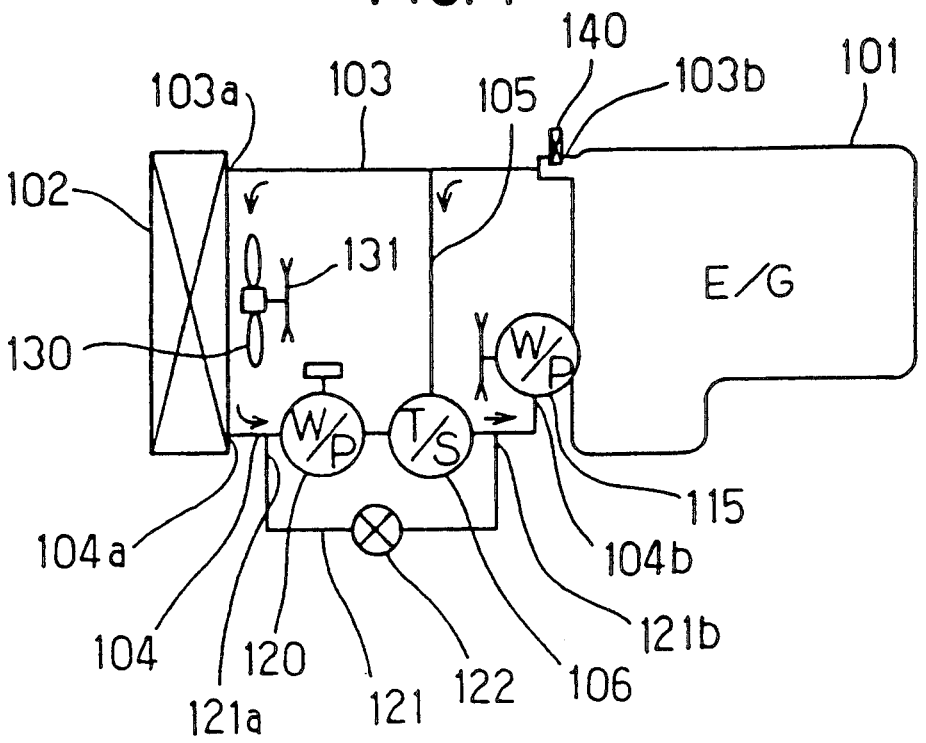
FIG. 1 is a schematic view of an embodiment according to the present invention.

An engine 101 and a radiator 102 are connected with each other through a first conduit 103 and a second conduit 104. One end 103*a* of the first conduit 103 is connected to an inlet of the radiator 102 and the other end 103*b* is connected to a cylinder head of the engine 101. One end 104*a* of the second conduit 104 is connected to an outlet of the radiator 102 and the other end 104*b* is connected to a cylinder block of the engine 101. The engine 101 exchanges heat with the cooling fluid, so that the cooling fluid becomes hot. The hot cooling fluid flows into the radiator 102 through the first conduit 103 and exchanges heat with the surrounding air to lower its temperature. The cold cooling fluid flows into the engine 101 through the second conduit 104 and flows up from the cylinder block to the cylinder head, thereby cooling the whole engine 101.

A first water pump 115 (a first circulating means) is provided in the second conduit 104, which is driven by the engine 101, and circulates the cooling fluid between the engine 101 and the radiator 102.

One end of a first bypass conduit 105 is connected to the second conduit 104 upstream from the first water pump 115. The other end of a radiator bypass conduit 105 is connected to the first conduit 103, so that the cooling fluid flowing in the first conduit 103 can bypass the radiator 102.

A first water switching valve 106 is disposed at a connecting point of the first bypass conduit 105 and the second conduit 104. When the temperature of the cooling fluid flowing into the first bypass conduit 105 from the first conduit 103 is lower than the predetermined value, the first water switching valve 106 opens the first bypass conduit 105. When the temperature of the same is higher than the predetermined value, the first water switching valve 106 closes the first bypass conduit 105, so that all of the cooling fluid flowing in the first conduit 105 flows into the radiator 102.

A cooling fan 130 is disposed behind the radiator for forcing the cooling air through the radiator 102. The cooling fan 130 is driven by an electric motor 131 or an oil motor (not shown).

A water temperature sensor 140 for detecting the temperature of the cooling fluid coming out of the engine 101 is provided in the first conduit 103. A wall temperature sensor for detecting the wall temperature of the engine 101 can also be provided instead of the water temperature sensor 140.

Figure 2:
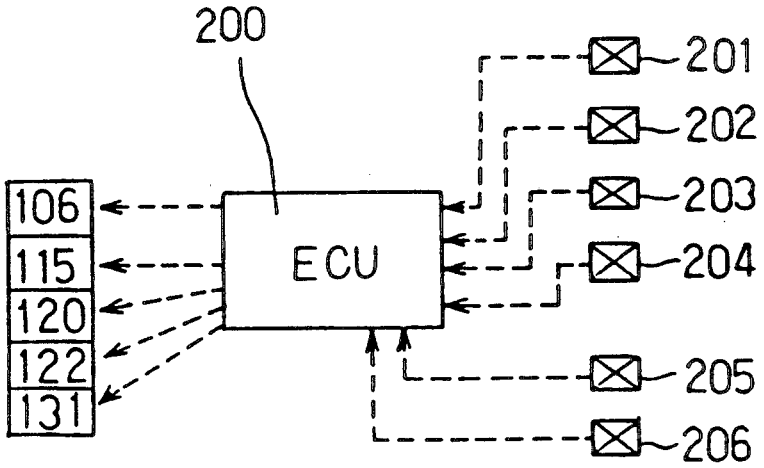
FIG. 2 is a diagram which shows a relationship between the ECU and other parts, FIG. 3 (Prior Art) is a diagram which shows a relationship between the engine r.p.m. and the discharge volume of the water pump.

As shown in FIG. 2, an electrical control unit (ECU) 200 receives signals from a outer air temperature sensor 201 for detecting the temperature of air outside of the automobile, an intake air temperature sensor 202 for detecting the temperature of air intaken into the cylinders of the engine 101, a negative pressure sensor 203 for detecting the pressure in an intake manifold, a velocity sensor 204 for detecting the velocity of the automobile, a rotation sensor 205 for detecting the r.p.m. of the engine, and a water temperature sensor 206 for detecting the temperature of the cooling fluid coming out of the engine 101. The ECU 200 calculates the best condition of the engine 101 and sends control signals to the first water switching valve 106, the second water pump 120, the second water switching valve 122 and the electric motor 131.

A second water pump (a second circulating means) 120 is disposed in the second conduit 104 upstream of the first water switching valve 106. The first water pump 115 and the second water pump 120 are connected with each other in series. The second water pump 120 is driven by an electric motor (not shown) and rotates independently of the engine rotation.

A second bypass conduit 121 is connected with the second conduit 104 in such a manner that the cooling fluid can bypass the second water pump 120. One end 121*a* of the second bypass conduit 121 is connected to the second conduit 104 upstream from the second water pump 120, and the other end 121*b* is connected to the second conduit 104 downstream from the first water switching valve 106.

Figure 3:
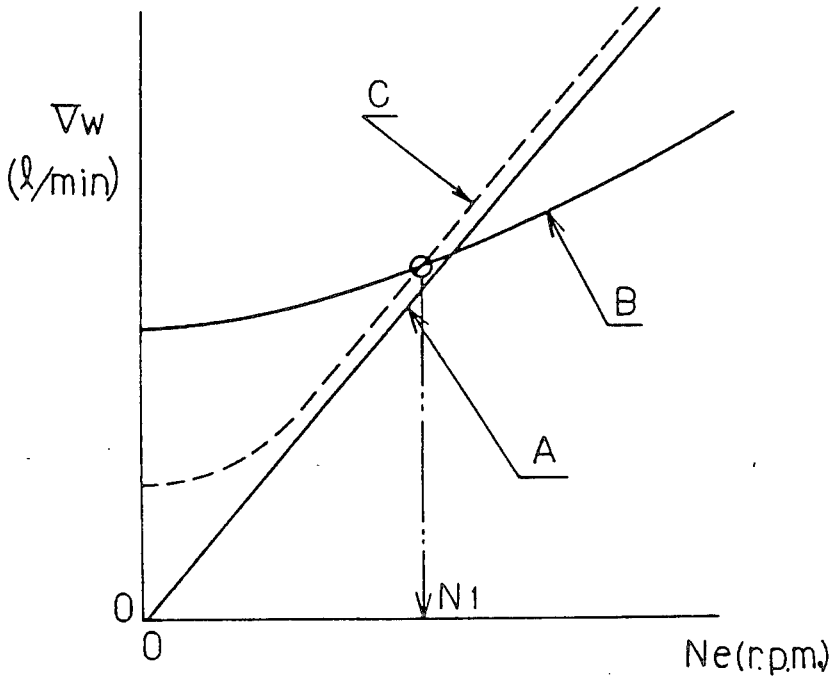
FIG. 3 (PRIOR ART)

The flow rate of the second water pump 120 is determined as follows. As shown in FIG. 3, the flow rate of the first water pump 115 increases in proportion to the r.p.m. The maximum flow rate of the first water pump 115 is determined so as to prevent cavitation at the time of maximum r.p.m. The radiator 102 requires the high radiating efficiency when the automobile is climbing a slope at low speed or the engine is idling. The flow rate of the second water pump 120 is determined so as to increase the flow rate of circulating cooling fluid when the first water pump 115 rotates at low speed.

Figure 11:
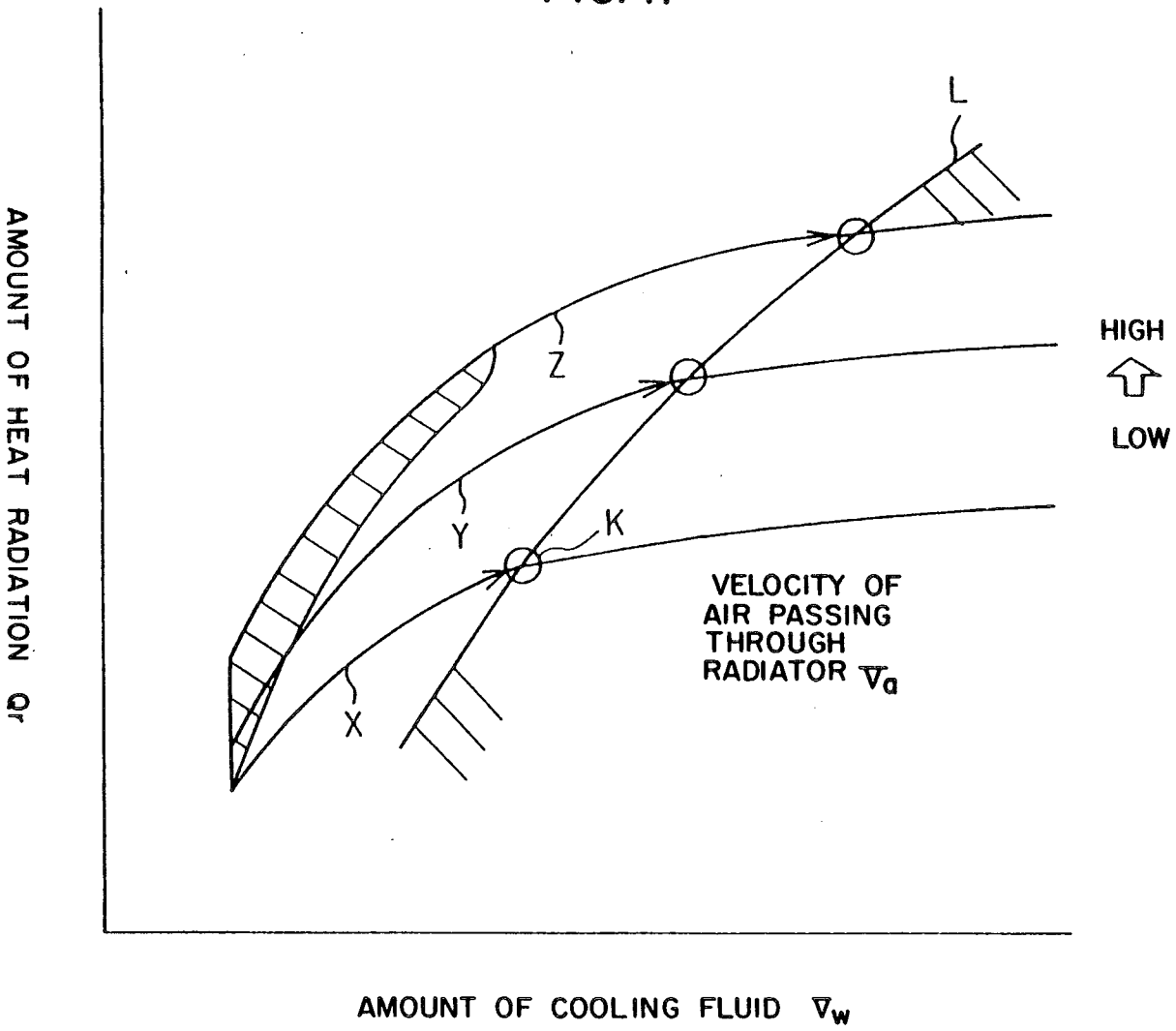
FIG. 11 is a diagram which shows a relationship between an amount of heat radiation of a radiator and an amount of cooling fluid passing through the radiator.

In FIG. 11, a line X represents the relationship between the flow of cooling fluid and the amount of heat radiated from the radiator when the velocity of air passing through the radiator is relatively low. A line Y represents the same when the velocity of air is moderate, and a line Z represents the same when the velocity of air is relatively high.

As shown in FIG. 11, the more the flow rate of the cooling fluid Vw increases, the more the amount of heat radiation Qr increases until the flow rate of the cooling fluid Vw reaches a certain amount. After that, the amount of heat radiation becomes almost constant. A point K wherein the amount of heat radiation becomes almost constant varies a position thereof according to the velocity Va of air passing through the radiator 102. A line L links each point K of lines, X, Y and Z and represents the maximum heat radiation of the radiator 102. In other words, when the velocity Va of air and the amount Qr of heat radiation of the radiator are determined, the flow rate Vw of cooling fluid is derived, wherein the radiator 102 operates most efficiently.

When the automobile climbs a slope at low speed or the engine is idling, the amount of air flow due to the velocity of the automobile is less significant. Rather, the amount of air passing through the radiator 102 depends on the capacity at the radiator fan 130. Therefore, the velocity Va of air passing through the radiator 102 is derived by the capacity of the radiator fan 130. The capacity of the radiator 102 based on the size thereof is derived by the arrangement of the radiator in an engine compartment, so that the flow rate Vw of the cooling fluid wherein the radiator 102 operates most efficiently, is derived.

The capacity of the second water pump 120 is determined in such a manner that the total discharge volume of the first water pump 115 and the second water pump 120 reaches the flow rate Vw of the cooling fluid.

A second control valve 122 which opens or closes the second bypass conduit 121, alternatively, is disposed in the second bypass conduit 121.

The operation of the embodiment will now be described. The first water pump 115 is driven by the engine. The first water pump 115 introduces the cooling fluid into the engine 101. The cooling fluid which has passed through the engine 101 and become hot flows into the radiator 102. The hot cooling fluid exchanges the heat with the outer air while flowing through the radiator 102, so that the temperature of the cooling fluid is lowered. The cold cooling fluid flows through the second conduit 104 and into the first water pump 115.

When the temperature of the cooling fluid which is detected by the sensor 140 is below the predetermined value (for example, below 40°-80° C.), the ECU 200 sends a signal to the first control valve 106 to open the first bypass conduit 105. An ordinary wax type thermostat can be used as the first control valve 106 instead of the electric control valve. The cooling fluid flows through he first bypass conduit 105 and bypasses the radiator 102. When the temperature of the cooling fluid detected by the sensor 140 reaches 40°-60° C., the first control valve 106 starts to close the first bypass conduit 105. When the temperature of the cooling fluid reaches 80° C., the first control valve 106 closes the first bypass conduit 105 completely. The temperature of cooling fluid for closing the first bypass conduit 105 can be varied according to the temperature of the outside air and the engine condition.

When the first water pump 115 is driven by the engine 101, the engine r.p.m. and the discharge capacity of the first water pump 115 are in proportion to each other. Generally, when the engine r.p.m. is approximately 3000 r.p.m., the discharge capacity of the first water pump is approximately 70-150'l/min. As shown by line A in FIG. 3, the more the engine r.p.m. increases, the more the flow rate of the cooling fluid increases.

The second control valve 112 closes the second bypass conduit 121 and the second water pump 121 is driven by an electric motor. When the engine r.p.m. is below N1 (3000-4000 r.p.m.), the flow rate of cooling fluid is increased by the second water pump 120 beside the first water pump 115. When the engine r.p.m. is above N1, the second water pump 120 operates as a flowing resistance and decreases the flow rate of cooling fluid.

On the other hand, as shown by line B in FIG. 3, when the second control valve 122 opens the second bypass conduit 121, the total flow rate of cooling fluid is increased in a whole range of engine r.p.m. more than when only the first water pump 115 is operated. However, the cooling fluid may circulate in the second bypass conduit 121, so that the flow rate of cooling fluid does not increase when the engine rotates at low speed under high load.

Figure 4:
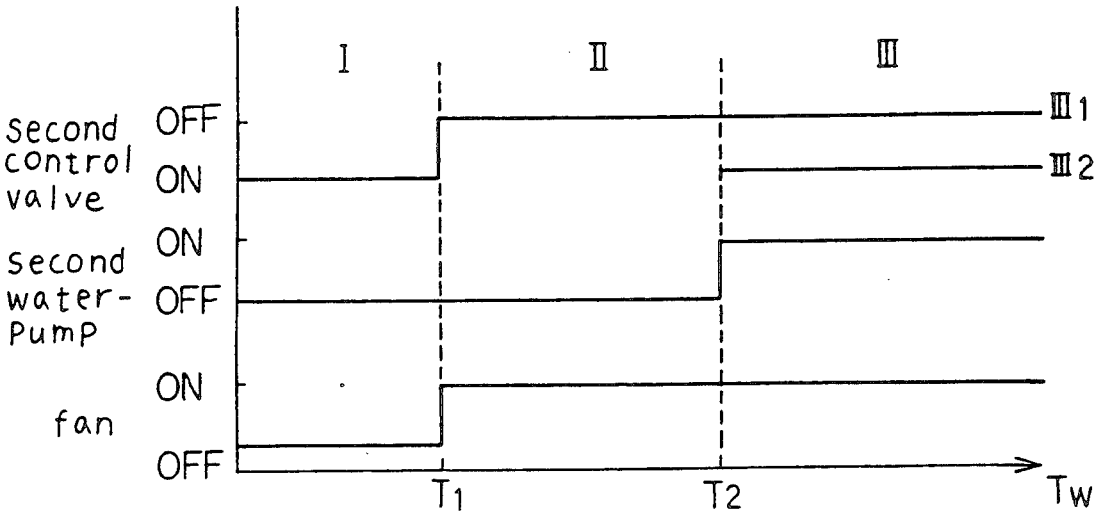
FIG. 4 is a diagram which shows the operation of a cooling fan, the second circulating means and the flow restricting means.

As shown in FIG. 4, the electric motor 131, the second water pump 120 and second control valve 122 are controlled according to the temperature Tw of the cooling fluid. When the temperature Tw is below T1 (40°-80° C.), the radiator fan 130 and the second water pump 120 are not driven and the second control valve 122 closes the second bypass conduit 121. Such an operation is called operation I.

When the temperature Tw is above T1, the radiator fan 130 is driven and the second control valve 122 opens the second bypass conduit 121. Such an operation is called operation II.

When the temperature Tw is above T2 (80°-100° C.), the second water pump 120 is driven and the second control valve 122 is controlled according to the engine r.p.m. and duration thereof (operation III). Under operation III, when the second control valve 122 opens the second bypass conduit 121, such a condition is called operation IIII, and when the second control valve 122 closes the second bypass conduit 121, such a condition is called op®ration III2.

Figure 5:
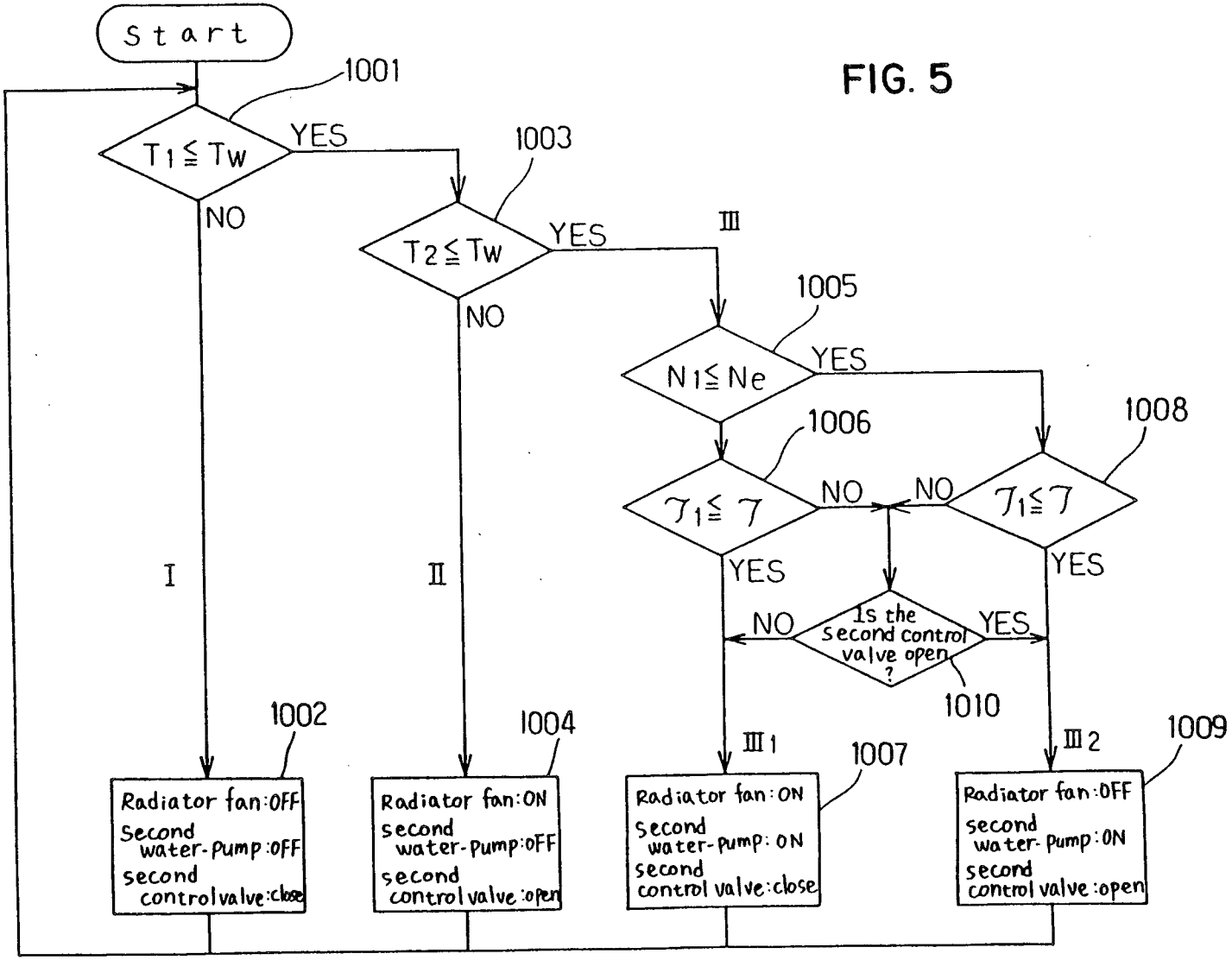
FIG. 5 is a flow chart of an embodiment.

The operation of the ECU 200 is carried out after the engine 101 starts, as shown in FIG. 5. When the temperature Tw of the cooling fluid is recognized to be below T1 based on the signal of the sensor 140 at step 1001, step 1002 (operation I) is carried out.

At step 1002, the electric fan 130 is not operated and the second control valve 122 closes the second bypass conduit 121. The first water pump 115 is driven by the engine 101 and the cooling fluid is introduced into the engine 101. The cooling fluid circulates through the engine 101, the first conduit 103, the radiator 102 and the second conduit 104. Since the temperature of the cooling fluid is relatively low, the radiator fan 130 does not operate and the flow rate of the cooling fluid is restricted. A portion of the cooling fluid flowing in the first conduit 103 flows into the first bypass conduit 105 to prevent over-cooling of the engine 101 ,and to raise the temperature of the cooling fluid rapidly. After that, step 1001 is carried out again in some micro seconds.

When the temperature Tw is recognized to be above T1 at step 1001, step 1003 is carried out.

When the temperature Tw is recognized to be below T2 according to the signal of sensor 140 at step 1003, step 1004 is carried out. At step 1004, the radiator fan 130 is operated and the second control valve 122 opens the second bypass conduit 121. The radiator fan 130 is driven by the electric motor 131 and cooling air is introduced toward the radiator 102 so as to cool down the cooling fluid flowing in the radiator 102. A portion of the cooling fluid flowing in the second conduit 104 is introduced into the second bypass conduit 121 and the remaining portion of the cooling fluid is introduced into the engine 101 after bypassing the second water pump 122. The pressure loss of the cooling fluid is prevented by bypassing the second water pump 122. According to the increment of temperature of the cooling fluid, the cooling fluid is cooled down and the flow rate of cooling fluid is increased, so that the temperature of the cooling fluid is maintained at the proper temperature (T1−T2) and the engine 101 is cooled efficiently.

When the temperature Tw of the cooling fluid is recognized to be above T2 (80°-100° C.) at step 1003, step 1005 is carried out.

When the engine r.p.m. Ne is recognized to be below N1 according to the signal of the sensor 205 at step 1005, step 1006 is carried out.

When the duration T is recognized to be above T1 (10 sec.-1 min.) according to the signal of the timer 206 at step 1006, step 1007 is carried out.

At step 1007, the radiator fan 130 and the second water pump 120 are driven and the second control valve 122 closes the second bypass conduit 121. The flow rate of cooling fluid which flows through the engine 101, the first conduit 103, the radiator 102 and the second conduit 104 is increased as shown by line B in FIG. 3, so that the temperature of the cooling fluid is maintained at the proper temperature (T1−T2).

After that, step 1001 is carried out again. When the temperature Tw becomes 40°-80° C., the first control valve 106 opens the first bypass conduit 105 and the cooling fluid flows in the first bypass conduit 105.

When the engine r.p.m. Ne is recognized to be above N1, step 1008 (the operation III2) is carried out.

When the duration T is recognized to be above T1 (5-10 min.) according to the signal of the timer 206 at step 1008, step 1009 is carried out. At step 1009, the radiator fan 130 starts to rotate, the second water pump 120 is driven and the second control valve 122 opens the second bypass conduit 121. The cooling fluid circulates through the engine 101, the first conduit 103, the radiator 102 and the second conduit 104, and the surplus cooling fluid flows into the second bypass conduit 121. The flow rate of cooling fluid is increased as shown by line C in FIG. 3. When the temperature of the cooling fluid is relatively high and the engine r.p.m. is maintained to be high, the cooling fluid bypasses the second water pump 122 to increase the flow rate of the cooling fluid, so that the temperature of the cooling fluid is kept to between T1−T2.

When the temperature Tw reaches 40°-80° C. at step 1001, the first control valve 106 opens the first bypass conduit 105 and the cooling fluid flows through the first bypass conduit 105.

When the duration T is recognized to be below T1 (10-60 sec.) at step 1 006 and step 1008, step 1010 is carried out. When the second control valve 122 closes the second bypass conduit 121, step 1007 is carried out, and when the second control valve 122 opens the second bypass conduit 121, step 109 is carried out.

According to the present invention as described above, the flow rate of the cooling fluid can be increased according to the capacity of the radiator 102 even when the automobile is running at low speed. Especially when the automobile climbs a slope at low speed or the engine rotates at low speed, the flow rate of the cooling fluid can be increased to an amount which can not be achieved by the first water pump alone, so that the cooling efficiency of the engine is improved. Furthermore, even when the automobile runs at high speed, the flow rate of the cooling fluid is maintained at a rate to cool the engine efficiently. The engine is cooled efficiently according t the frequently varying driving condition of the automobile.

Since the second bypass conduit 121 also bypasses the first control valve 106, the flowing resistance due to the first control valve 106 can be neglected.

Figure 6:
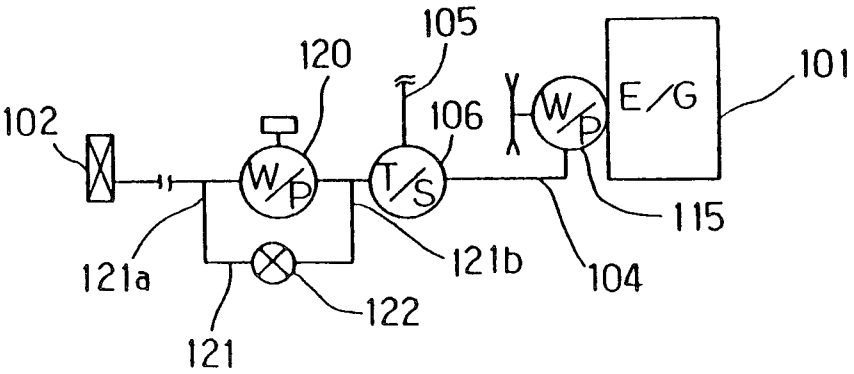
FIG. 6 is a partial schematic view of another embodiment.

As shown in FIG. 6, one end 121*a* of the second bypass conduit 121 can be connected to the second conduit 104 upstream of the second water pump 120, and the other end 121*b* of the second bypass conduit 121 can be connected to the second conduit 104 upstream of the first control valve 106.

Figure 7:
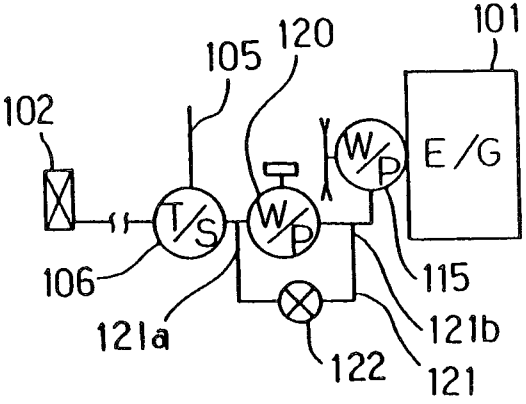
FIG. 7 is a partial schematic view of the other embodiment.
Figure 9:
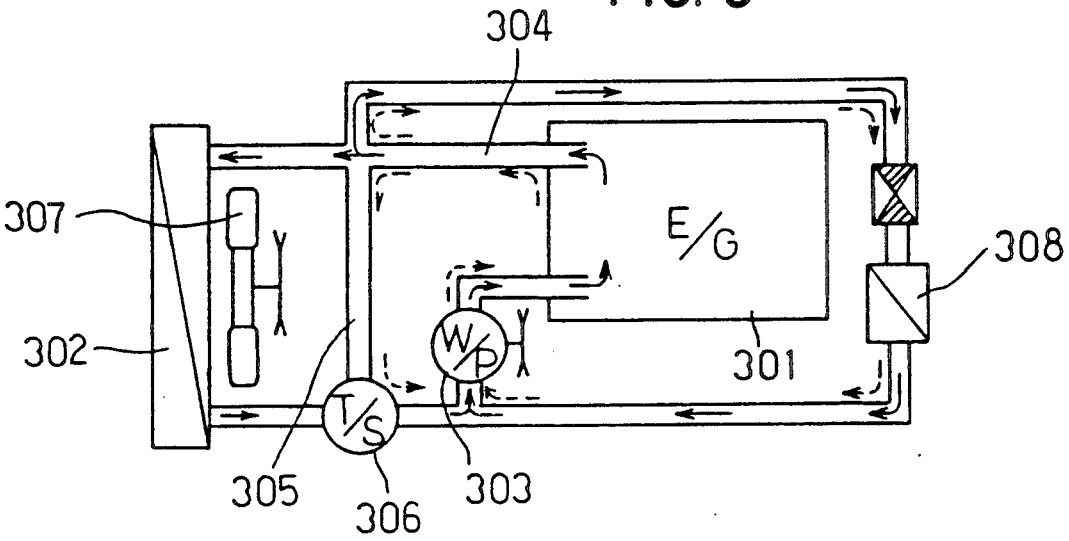
FIG. 9 is a schematic view of a conventional device.
Figure 10:
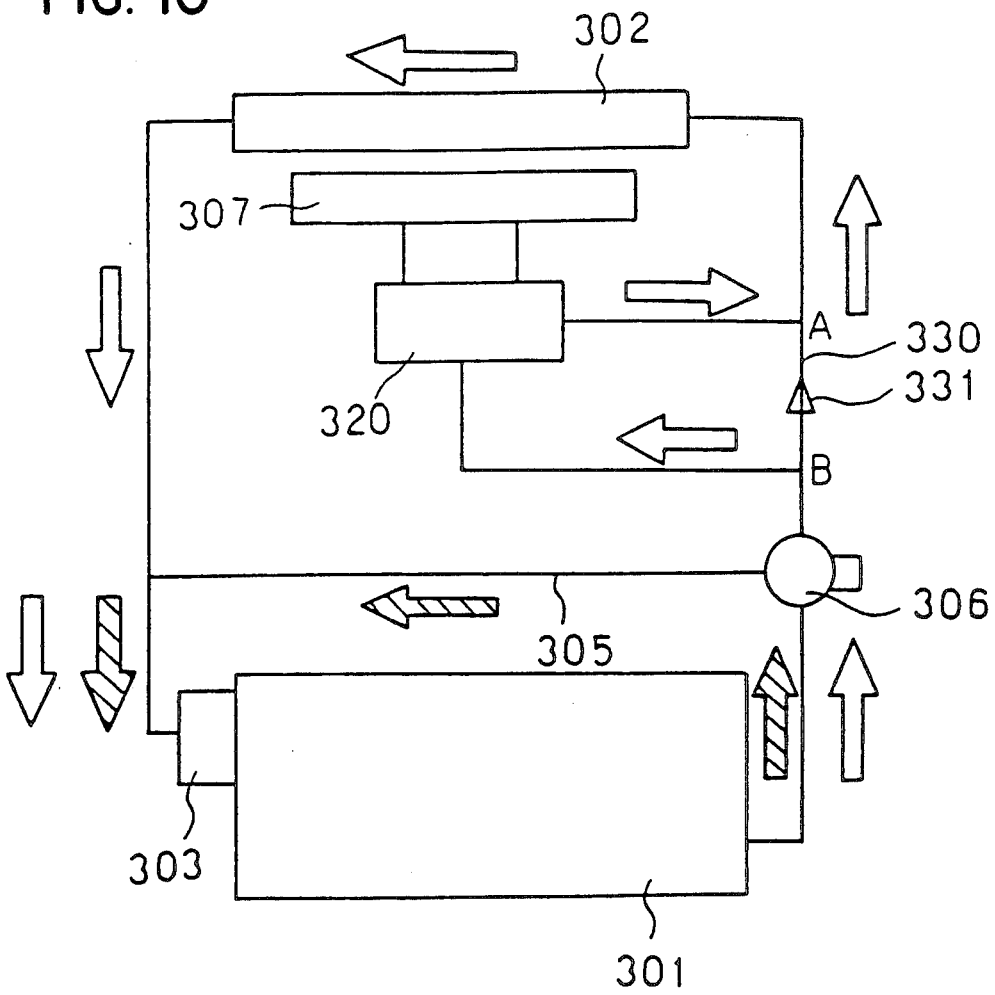
FIG. 10 is a schematic view of another conventional device.

As shown in FIG. 7, the second water pump 120 can be disposed downstream of the first control valve 106, with one end 121*a* of the second bypass conduit 121 connected to the second conduit 104 between the first control valve 106 and the second water pump 120, and the other end 121*b* of the second bypass conduit 121 connected to the second conduit downstream of the second water pump 120.

Figure 8:
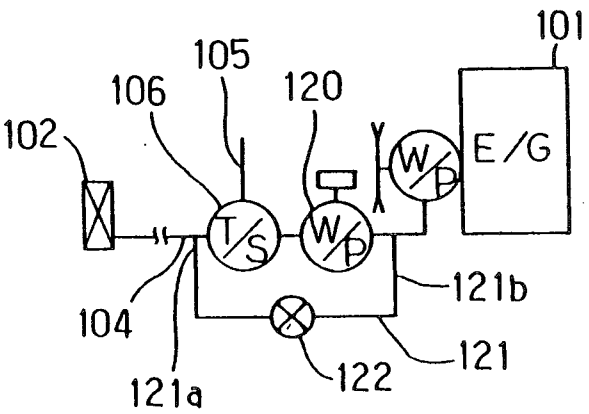
FIG. 8 is a partial schematic view of the other embodiment.

As shown in FIG. 8, the second water pump 120 can be disposed downstream of the first control valve, and the second bypass conduit 121 can be connected upstream of the first control valve 106 and downstream of the second water pump 120.

The first water pump 115 and the second water pump 120 can be disposed in the first conduit. However, alternatively, only one of the first water pump 115 and the second water pump 120 can be disposed in the first conduit 103.

When an opening pressure of a radiator cap (not shown) is considered, the first water pump 115 should be provided in the second conduit 104 near the engine 101 and the second water pump 120 should be provided upstream of the first water pump 115.

An electric valve which controls the flow rate of the cooling fluid or an electric valve which opens or closes the conduit alternatively, can be used as the second control valve 122. The first water pump 115 can be driven by oil pressure or exhausted gas.

An electromagnetic clutch (not shown) can be disposed between the first water pump 115 and the engine 101. When the flow rate of the first water pump 115 exceeds a certain value, the electromagnetic clutch disconnects the first water pump 115 from the engine 101. Therefore, the pressure difference between an intake area and a discharge area of the first water pump 115 is decreased, so as to prevent cavitation in the first water pump 115. The second control valve 122 can be controlled according to the flow rate of the cooling fluid.

FIG. 2 shows another embodiment of the present invention. The first control valve 106 and the second control valve 122 are combined to be a control valve 405. The control valve 405 is disposed at a junction of the first bypass conduit 109, the second conduit 104 and the second bypass conduit 121.

Figure 13:
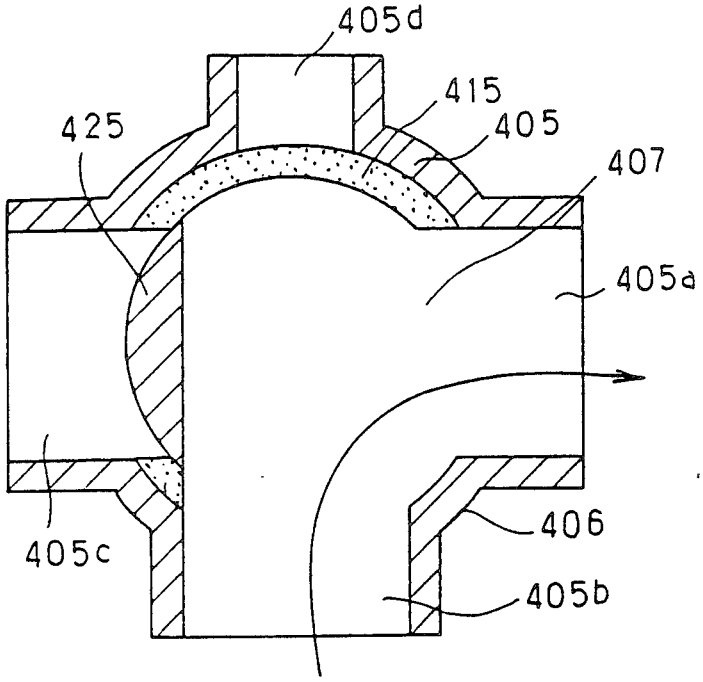
FIG. 13 is a sectional view of a water switching valve shown in FIG. 12.

As shown in FIG. 13, the control valve 405 comprises a cylindrical housing 406 wherein a passage 407 is formed as a part of the second conduit 104. The passage 407 is connected to the first bypass conduit 109 at a first opening 405*d*, and to the second bypass conduit 121 at a second opening 405*c*. The housing 406 has also a third opening 405*d* and a fourth opening 405*a*.

Figure 14:
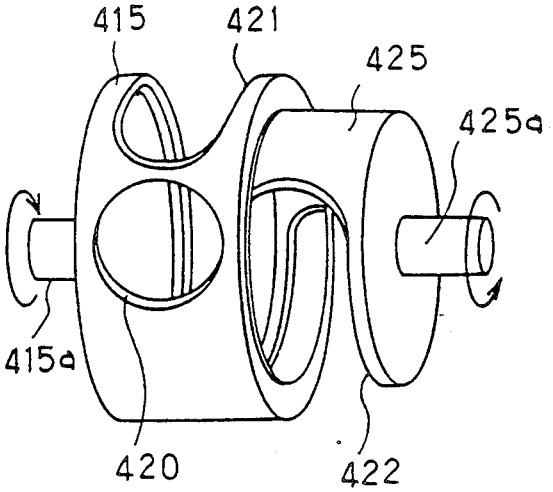
FIG. 14 is a schematic view of the water switching valve.
Figure 15:
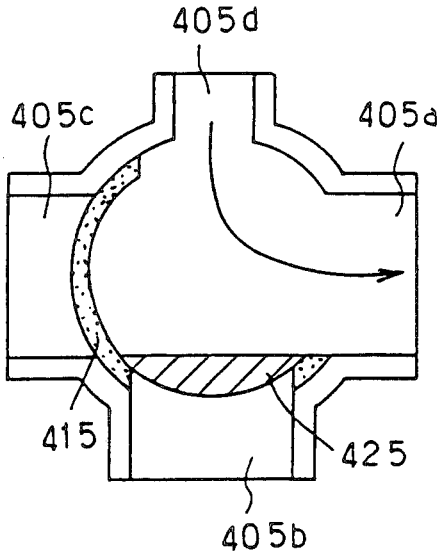
FIG. 15 through FIG. 17 are sectional views which show the operation of the water switching valve.

A cylindrical first valve 415 is rotatably disposed in the housing 406 while maintaining a water seal against an inner surface of the housing 406. A second valve 425 which is shown in FIG. 14 is rotatably disposed in the first valve 415 while maintaining a water seal against an inner surface of the first valve 415. The first valve 415 has an axis 415*a* to which a driving force is transmitted from a step motor or servo motor (not shown). The second valve 425 has an axis 425*a* which receives a driving force from a step motor or a servo motor (not shown).

The housing 406 is made from resin, for instance, polypropylene or nylon. A metal such as brass can also be used instead of resin.

As shown in FIG. 14, the first valve 415 and the second valve 425 have openings 420, 421 and 422 and the flowing direction of the passage 407 is varied by opening or closing the openings 420, 421, and 422. The driving motor which rotates the first valve 415 and the second valve 425 is controlled by ECU 200 according to the signals of the sensors.

The operation of the embodiment shown in FIG. 12 will now be described. When the sensor 206 detects that the temperature of cooling fluid is below the first value (40°-80° C.), the motor drives the first valve 415 and the second valve 425 to the position wherein the fourth opening 405*a* connected to the second conduit 104 and the first opening 405*d* connected to the first bypass conduit 105 are connected with each other and the third opening 405*b* connected to the second water pump 120 and the second opening 405*c* connected to the second bypass conduit 121 are closed. The cooling fluid discharged from the engine 101 flows in the first bypass conduit 105 so as to bypass the radiator 102.

Figure 16:
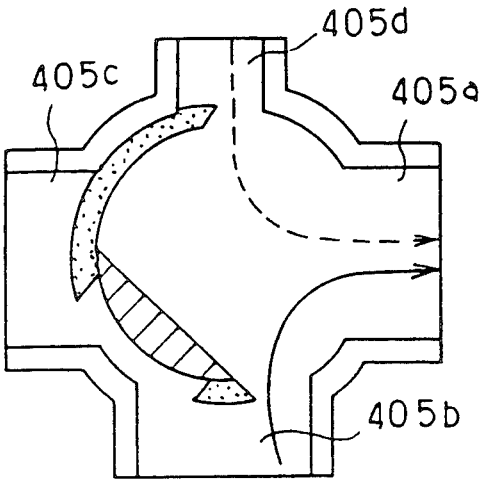

When the sensor 206 detects that the temperature of the cooling fluid is above the first value (40°-80° C.) and below the second value (80°-100° C.), the motor drives the first valve 415 and the second valve 425 to the position wherein the area of the first opening 405*d* is decreased and the third opening 405*b* is opened to some extent as shown in FIG. 16. The cooling fluid which flows in the first bypass conduit 105 and the cooling fluid which flows in the second conduit 104 toward the second water pump 120 through the radiator 102 is controlled by the first valve 415 and the second valve 425. The second water pump 120 is not driven by the motor (not shown) to increase the flow rate of the cooling fluid. The second water pump 120 operates as flowing resistance. The first valve 415 and the second valve 425 are controlled so as to vary the rate of cooling fluid flow in the first bypass conduit 105 and in the radiator 102 according to the variation of the temperature of the cooling fluid. The variation of the temperature of the cooling fluid is estimated based on the signals of the temperature sensor 206, the outside air temperature sensor 201, the intake air sensor 202, the intake air pressure sensor 203, the velocity sensor 204 and the engine r.p.m. sensor 205. The first valve 415 and the second valve 425 are controlled according to this estimation.

Figure 17:
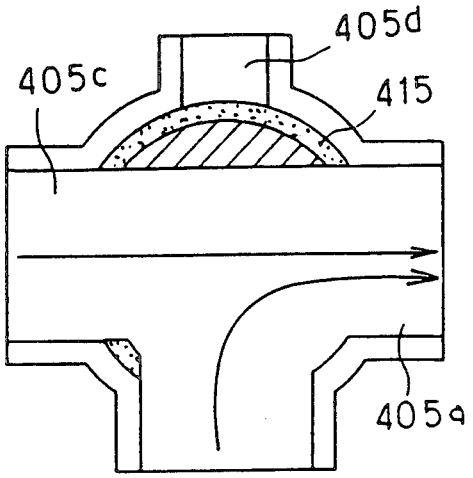

When the sensor 206 detects that the temperature of the cooling fluid is above the second value (80°-100° C.), the first valve 415 is driven so as to close the first opening 405*d* which is connected to the first bypass conduit 105 as show in FIG. 13 and FIG. 17, so that all of the cooling fluid flows into the radiator 102. The amount of heat radiated by the radiator is calculated based on the signals from the sensors 201-206. The second water pump 120 starts to rotate when the radiator 102 is required to radiate more heat.

The second valve 425 closes the second opening 405*c* which is connected to the second bypass conduit 121 as shown in FIG. 13. The first water pump 115 and the second water pump 120 are operated in series and the radiator 102 radiates the heat most efficiently.

When the engine r.p.m. is above N1, the second water pump 120 does not rotate even if the temperature of the cooling fluid is above the second value (80°-100° C.). In such a case, the second valve 425 is driven so as to open the second opening 405*c* which is connected to the second bypass conduit 121, as shown in FIG. 17. The cooling fluid flows toward the fourth opening 405*a* through the second bypass conduit 120 but toward the second water pump 120.

Figure 12:
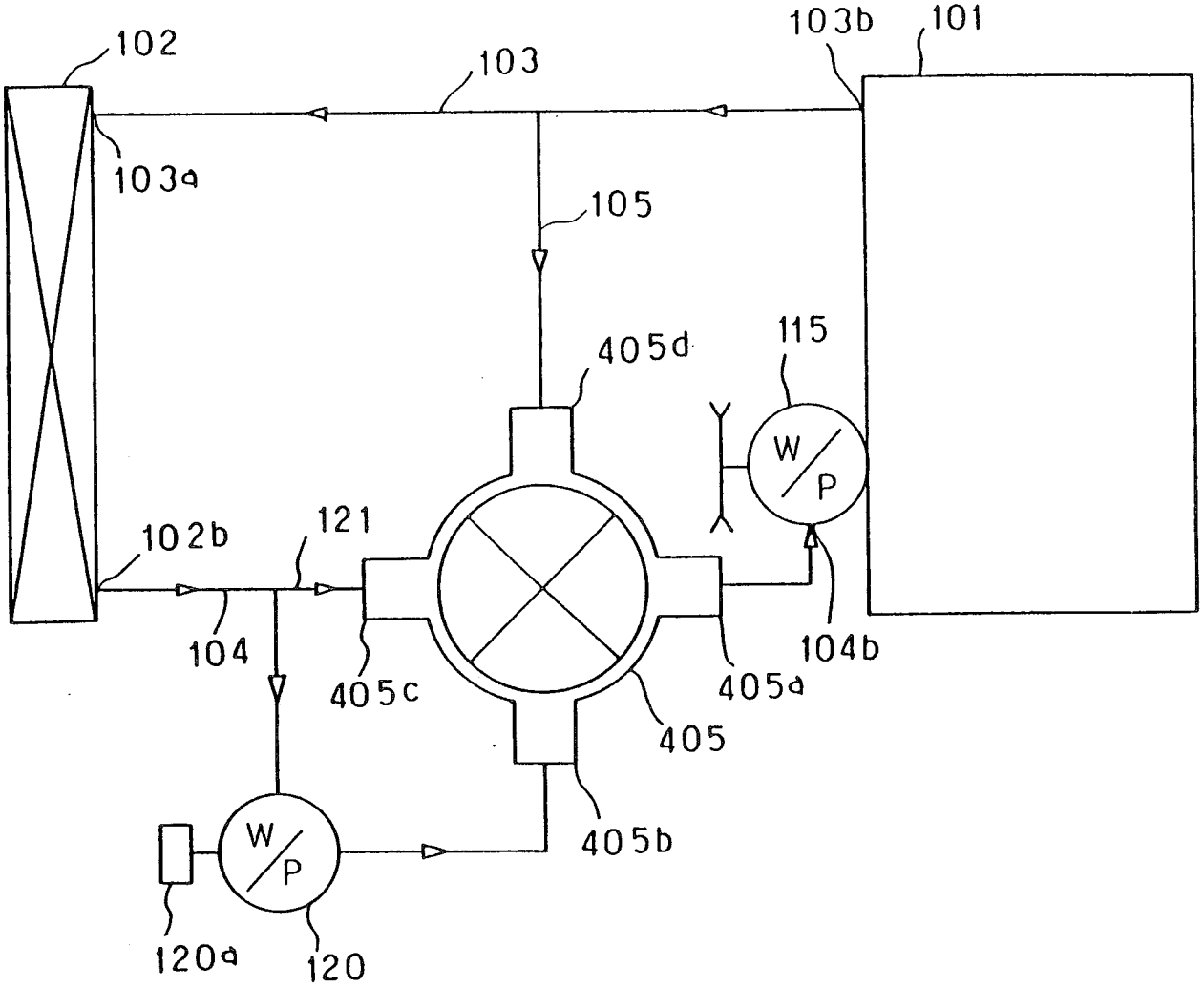
FIG. 12 is a schematic view of the other embodiment.

In the embodiment shown in FIG. 12, since the control valve 405 controls the rate of cooling fluid flow in the first bypass conduit 105, the second bypass conduit 121 and the second water pump 120, the fluctuation of the temperature of the cooling fluid is minimized. The first valve 415 and the second valve 425 are driven according to the estimation of heat load based on the signals of the sensors 201-205, to prevent the fluctuation of the temperature of the cooling fluid.

Figure 18:
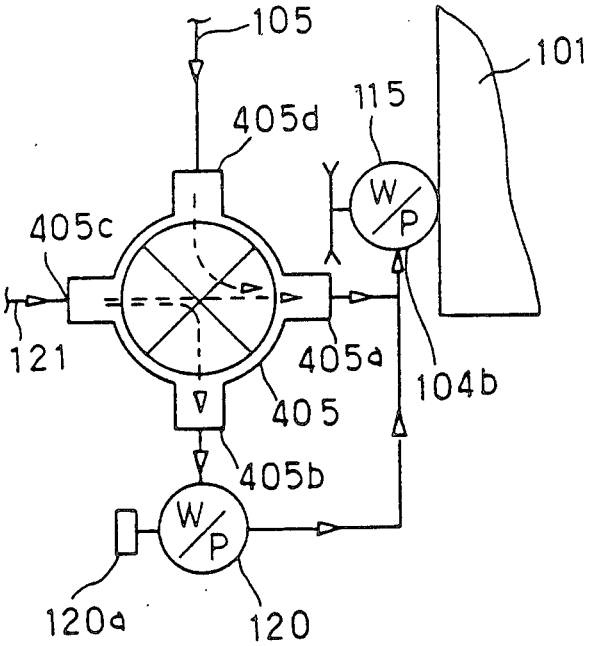
FIG. 18 and FIG. 19 are schematic views which show essential portions of the other embodiment.

As shown in FIG. 18, the second water pump 120 can be disposed downstream of the control valve 405.

Figure 19:
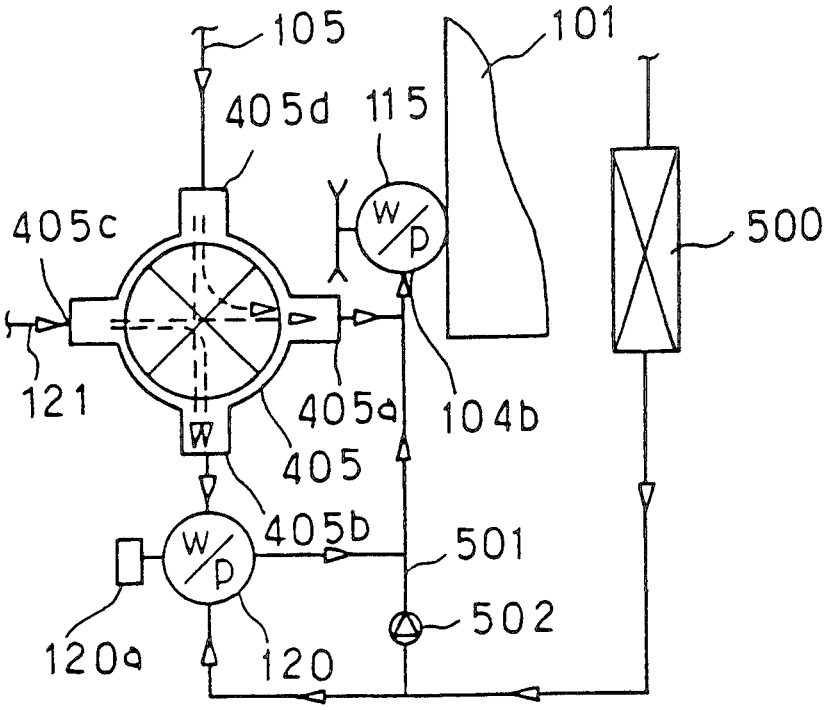

AS shown in FIG. 19, a heater core 500 can be provided upstream of the second water pump 120. A third bypass conduit 501 which bypasses the second water pump 120 is provided in order to prevent the decrease of the rate of the cooling fluid flow in the heater core 500 when the second water pump 120 does not rotate. A check valve 502 is provided in the third bypass conduit 501.

Figure 20:
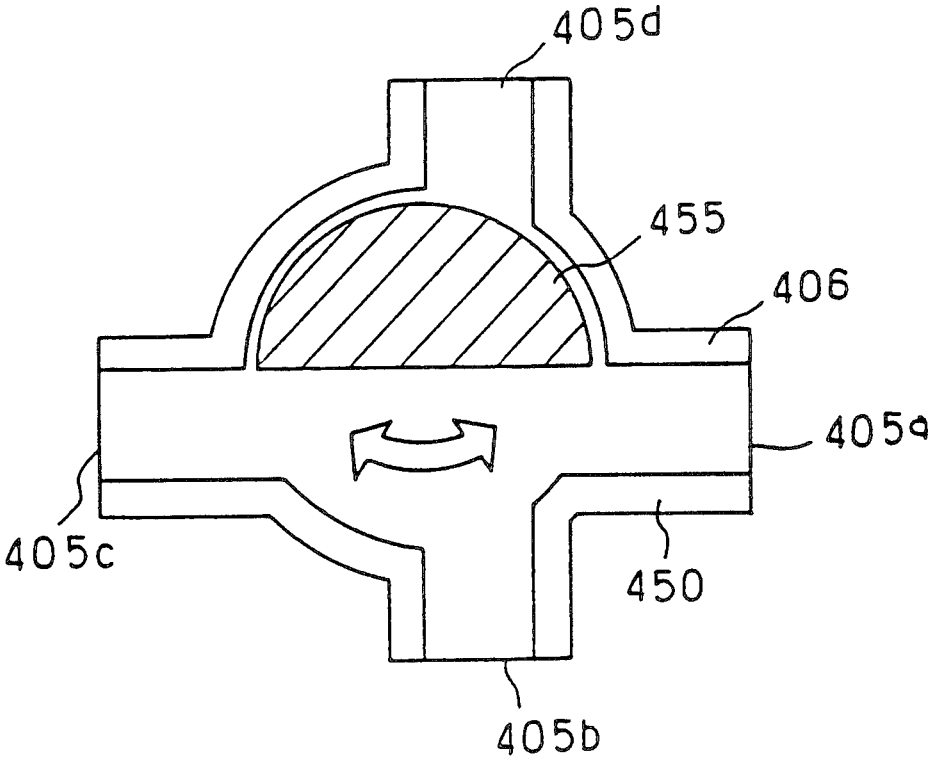
FIG. 20 is a sectional view of a water switching valve, and FIGS. 21(*a*) through FIG. 21(*d*) are schematic views which show the operation of the water switching valve shown in FIG. 20.
Figure 21A:
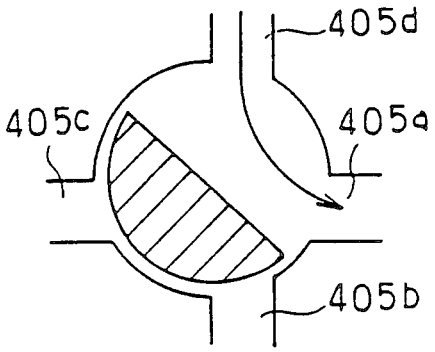
Figure 21B:
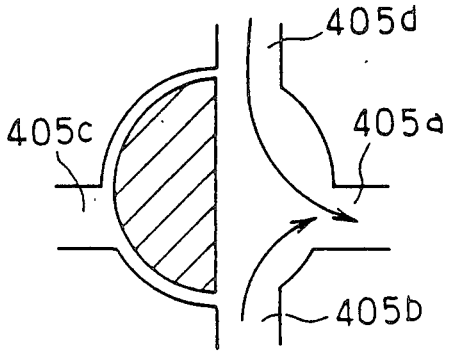
Figure 21C:
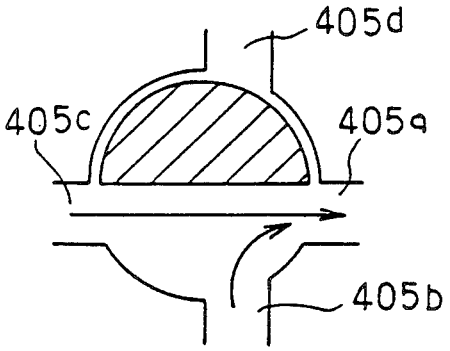
Figure 21D:
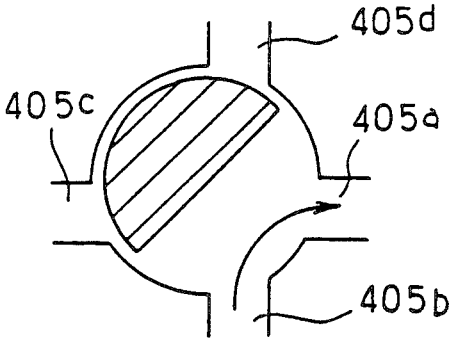

FIG. 20 shows the other embodiment of the present invention wherein the control valve 405 is modified. The control valve 405 includes the first valve 455 which opens or closes the first opening 405*d*, the second opening 405*c*, the third opening 405*b* and the fourth opening 405*a*, alternatively. FIG. 21 shows the operation of the control valve 405. In FIG. 21(*a*), the cooling fluid flows in the first bypass conduit 105. In FIG. 21(*b*), the cooling fluid flows in the first bypass conduit 105 and the second conduit 104. In FIG. 21(*d*), the first opening 405*a* is closed, the second opening 405*c* is opened and the second water pump 120 is not driven. In FIG. 21(*d*), the first opening 405*a* and the second opening 405*c* are closed and the second water pump 120 is not driven. The other operations of the control valve 455 are the same as the control valve shown in FIG. 12.

What is claimed is:

1. A cooling device for an internal combustion engine, comprising:

a heat exchanger for cooling a cooling fluid of an engine by dissipating heat to a surrounding air;

a first conduit for introducing the cooling fluid into the heat exchanger from the engine;

a second conduit for introducing the cooling fluid cooled by the heat exchanger into the engine;

a first circulating means driven by the engine for circulating the cooling fluid;

a second circulating means for circulating the cooling fluid independently from the first circulating means, said second circulating means being disposed in series with the first circulating means and controlled to start circulating the cooling fluid when a temperature of the engine is above a predetermined value;

a bypass conduit for controlling the cooling fluid to bypass the second circulating means, said bypass conduit being provided in parallel with the second circulating means; and a valve means for opening the bypass conduit when a flow rate of the cooling fluid which is circulated by the first circulating means and the second circulating means is above a predetermined value.

2. A cooling device for an internal combustion engine as in claim 1, wherein the first circulating means includes a means for decreasing a discharge flow rate of the cooling fluid when a total flow rate of the cooling fluid is above a second predetermined value.

3. A cooling device for an internal combustion engine as in claim 2, wherein the decreasing means comprises an electromagnetic clutch which disconnects the drive of the first circulating means from the engine, thereby presenting the first circulating means from forcefully circulating the cooling fluid.

4. A cooling device for an internal combustion engine, comprising:

a heat exchanger for cooling a cooling fluid of an engine by dissipating heat to a surrounding air;

a first conduit for introducing the cooling fluid into the heat exchanger from the engine;

a second conduit for introducing the cooling fluid cooled by the heat exchanger into the engine;

a first bypass conduit which connects the first conduit with the second conduit to bypass the heat exchanger;

a first circulating means driven by the engine for circulating the cooling fluid;

a second circulating means for circulating the cooling fluid independently from the first circulating means, said second circulating means being disposed in series with the first circulating means;

a second bypass conduit for controlling the cooling fluid to bypass the second circulating means, said bypass conduit being provided in parallel with the second circulating means; and a valve means for controlling a flow rate of the cooling fluid which flows in the first bypass conduit and the second bypass conduit.

5. A cooling device for an internal combustion engine as in claim 4, wherein, the valve means opens the first bypass conduit when the temperature of the cooling fluid is below a first predetermined value, opens the first bypass conduit to introduce a portion of the cooling fluid into the first bypass conduit when the temperature of the cooling fluid is between the first predetermined value and a second predetermined value, closes the first bypass conduit to introduce the entire flow of cooling fluid into the radiator when the temperature of the cooling fluid is above the second predetermined value, and opens the second bypass conduit when the flow rate of the cooling fluid is above a predetermined value according to a signal which corresponds to a rate of the cooling fluid flowing through the second circulating means.

6. A cooling device for an internal combustion engine as in claim 5, wherein the valve means opens the second bypass conduit according to the engine r.p.m.

7. A cooling device for an internal combustion engine as in claim 4, wherein the valve means is disposed at a junction of the second conduit, the first bypass conduit and the second bypass conduit.

8. A cooling device for an internal combustion engine as in claim 7, wherein the valve means comprises a cylindrical housing in which a first opening connecting the first bypass conduit with the second conduit and a second opening connecting the second bypass conduit with the second conduit are disposed, and a valve body which is rotatably disposed in the housing to control the rate of the cooling fluid flow through the second conduit, the first opening and the second opening.

* * * * *